US006769202B1

(12) United States Patent
Luthi et al.

(10) Patent No.: US 6,769,202 B1
(45) Date of Patent: Aug. 3, 2004

(54) SHOE AND SOLE UNIT THEREFOR

(75) Inventors: Simon Luthi, Lake Oswego, OR (US); Geoff Raynak, Lake Oswego, OR (US); Paul Gaudio, Portland, OR (US); Charles Kraeuter, Lake Oswego, OR (US)

(73) Assignee: Kaj Gyr, Nelson (CA)

( * ) Notice: Subject to any disclaimer, the term of this patent is extended or adjusted under 35 U.S.C. 154(b) by 0 days.

(21) Appl. No.: 10/109,593

(22) Filed: Mar. 26, 2002

Related U.S. Application Data

(60) Provisional application No. 60/278,907, filed on Mar. 26, 2001.

(51) Int. Cl.[7] ..... A43B 13/18; A43B 13/38; A43B 23/00

(52) U.S. Cl. ..... 36/28; 36/30 R; 36/3 B; 36/44

(58) Field of Search ..... 36/28, 27, 30 R, 36/31, 32 R, 102, 103, 114, 3 B, 140, 144, 43, 44

(56) References Cited

U.S. PATENT DOCUMENTS 4,245,406 A * 1/1981 Landay et al. ..... 36/30 R
4,451,994 A * 6/1984 Fowler ..... 36/28
4,611,412 A * 9/1986 Cohen ..... 36/28
5,337,492 A * 8/1994 Anderie et al. ..... 36/28
5,461,800 A * 10/1995 Luthi et al. ..... 36/28
5,713,140 A * 2/1998 Baggenstoss ..... 36/103
5,839,208 A * 11/1998 Huang ..... 36/28
6,115,943 A * 9/2000 Gyr ..... 36/28
6,438,870 B2 * 8/2002 Nasako et al. ..... 36/28
6,457,261 B1 * 10/2002 Crary ..... 36/28

FOREIGN PATENT DOCUMENTS

EP 0479183 * 4/1992 ..... A43B/13/14

* cited by examiner

*Primary Examiner*—Anthony D. Stashick
(74) *Attorney, Agent, or Firm*—Christensen O'Connor Johnson Kindness PLLC

(57) ABSTRACT

The sole unit (12) for a shoe includes a directional element (16), a cushioning element (18) and a heel cradle (20). The sole unit (12) may be attached to a shoe upper (14) by conventional methods, such as by gluing, stitching, or other means of bonding or physical attachment. The sole unit (12) provides foot support, cushioning, energy return, stability, torsion control, and optionally abrasion resistance to the user. The functional advantages of this construction of the sole unit (12) are primarily achieved through the directional elements (16) and cushioning element (18), each of which handle certain distinct functions of the shoe (10).

26 Claims, 9 Drawing Sheets

SHOE AND SOLE UNIT THEREFOR

CROSS-REFERENCES TO RELATED APPLICATIONS

This application claims the benefit of U.S. Provisional Application No. 60/278,907, filed Mar. 26, 2001, the disclosure of which is hereby incorporated by reference.

FIELD OF THE INVENTION

The present invention relates to soles for shoes, and more particularly, relates to a sole unit for an athletic shoe.

BACKGROUND OF THE INVENTION

When running, a person pushes off on the toe of their foot, arcs their foot through the air and sets their foot down on the ground in front of their body. For most athletes, their heel strikes first, and their foot pronates slightly as they roll forward onto the ball of the foot. The process is then repeated by pushing off on the ball of their foot or toes. This heel-to-toe motion is common among athletes. When the heel strikes the ground, significant impact forces are created that must be attenuated by the athlete and shoes. Without proper cushioning mechanisms built into the shoe, these impact forces can create acute or overuse injuries. Further, forces are generated along various axes of the shoe. Without proper stability mechanisms, injury or loss of athletic performance are possible.

To lessen an athlete's potential injury by reducing the impact upon the athlete, a shoe must attenuate impact. Since the impact force is the overall force divided by time of force application, the most efficacious method of absorbing shock is by extending the time of force application, and thereby lessening the peak force upon the athlete. This can be done, for example, by allowing for travel in the heel as it strikes the ground. This curtails the amount of shock communicated to the athlete's body.

Some prior art shoes address the problem of shock absorption by using a variety of micro-cellular foams, gels or air bladders, which offer minimal travel. Softer soles provide more cushion and shock absorption, but in so doing compromise the angular stability of the foot. Conversely, firmer soles better stabilize the foot, but provide commensurately less shock absorption. In conventional shoes, the cushioning foams, gels, air bladders and such play a dual role in providing a platform for stabilizing the foot.

SUMMARY OF THE INVENTION

The present invention provides a sole unit for a shoe having superior stability and shock absorption properties in a sole unit design that can be customized for different applications and body-type characteristics. The sole unit provides discrete components for addressing stability and shock absorption needs. In addition, the present invention provides a high performance sole unit having superior durability.

In one embodiment of the present invention, the sole unit includes a directional element operable to provide flexibility in a longitudinal direction of the sole unit and to provide stiffness in a lateral direction of the sole unit. The sole unit further includes a cushioning element operably coupled to the directional element. The cushioning element is operable to absorb an impact force applied to the directional element.

In another embodiment of the present invention, the directional element is adapted to be connected to an upper of a shoe and includes a top member, a bottom member, and at least one resiliently flexible strut member therebetween. The strut member supports the top member a spaced distance away from the bottom member.

In still another embodiment of the present invention, the sole unit includes a directional element having a top member, a bottom member, and a plurality of spaced apart resiliently flexible strut members. The strut members extend between the top and bottom members from the medial side to the lateral side of the sole unit for supporting the top member a spaced distance away from the bottom member. The sole unit further includes a plurality of cushioning members adapted to be received by the directional element. The cushioning members are operable to absorb an impact force applied to the top or bottom member.

In yet another embodiment of the present invention, the sole unit is incorporated into a shoe by being coupled to the shoe upper. The sole unit includes a directional element having a top member, a bottom member, and a plurality of spaced apart resiliently flexible strut members. The strut members extend between the top and bottom members from the medial side to the lateral side of the sole unit. The strut members support the top member a spaced distance away from the bottom member. The sole unit further includes a plurality of cushioning members adapted to be received by the directional element between the strut members. The cushioning members are operable to absorb an impact force applied to the top or bottom member.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
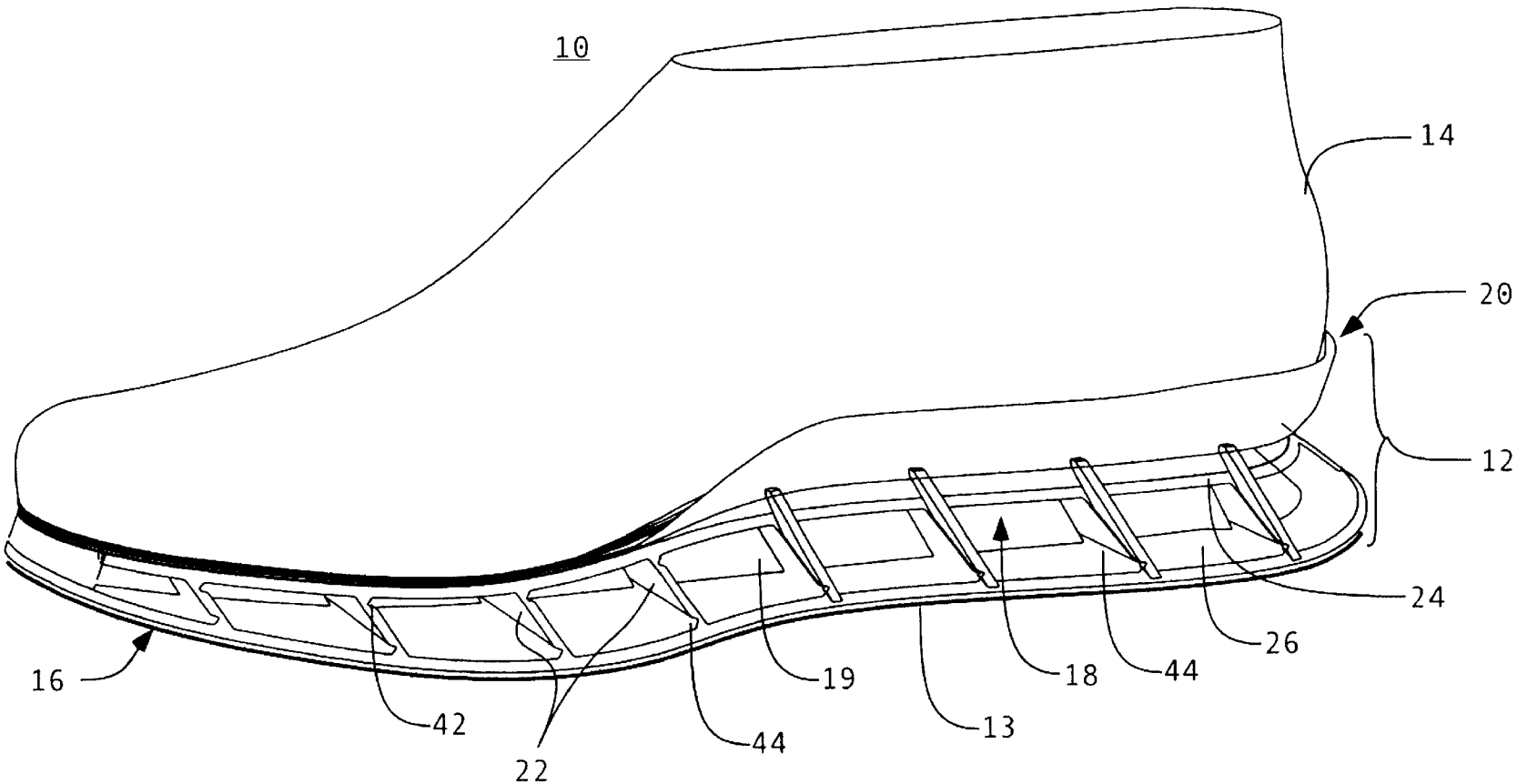
FIG. 1 is a perspective view of a shoe according to the present invention.
Figure 2:
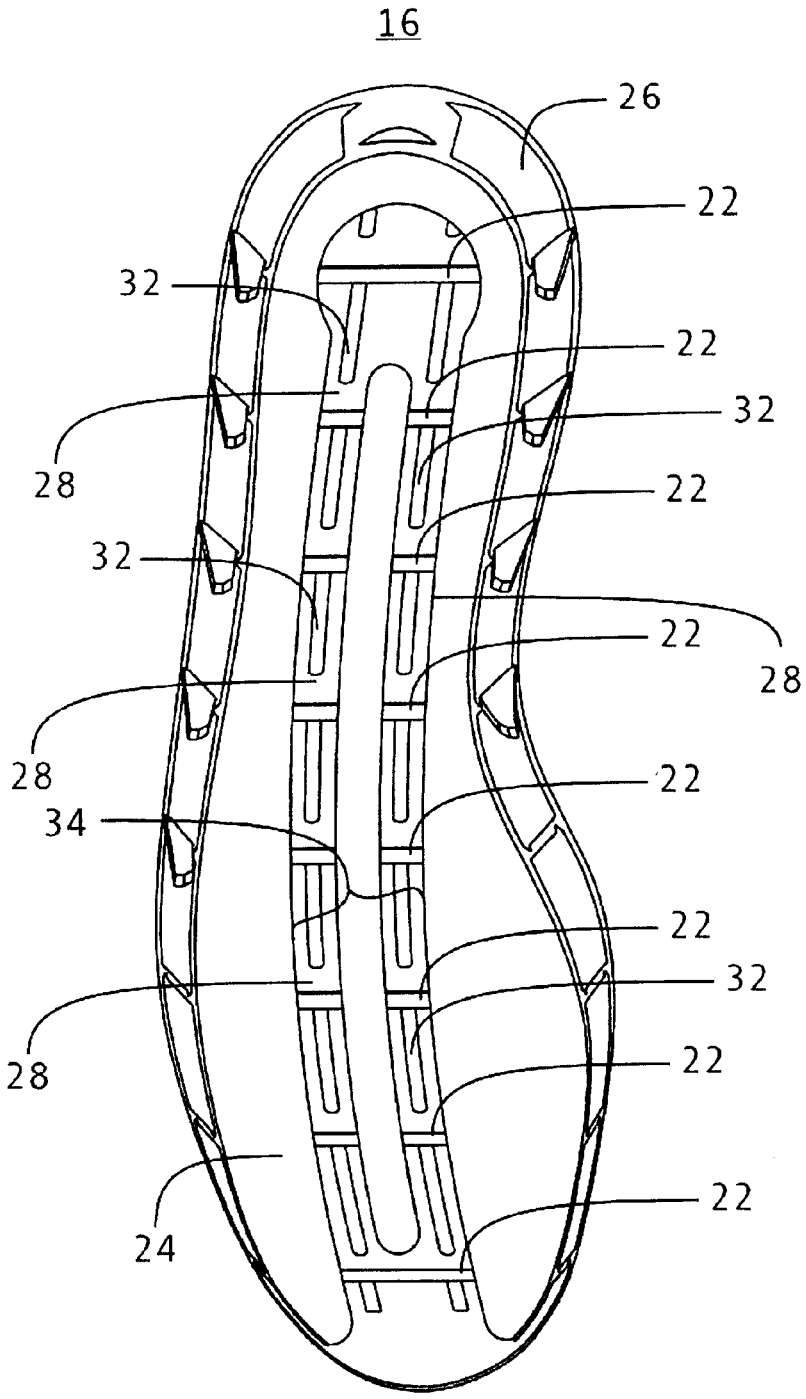
FIG. 2 is a top view of a directional element according to the present invention.
Figure 4:
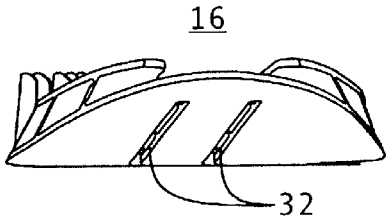
FIG. 4 is a front view of the directional element of FIG. 2.

FIG. 1 illustrates a shoe 10 comprising a sole unit 12 and an upper 14. The sole unit 12 consists of a directional element 16, a cushioning element 18 and a heel cradle 20. The assembly of the directional element 16, cushioning element 18 and the heel cradle 20 comprise the sole unit 12 and may be attached to the shoe upper 14 by conventional means, such as by gluing, stitching, or other means of bonding or physical attachment. The sole unit 12 may also include an abrasion resistance element 13 for frictional contact with ground or floor surfaces. Optionally, the abrasion resistant element 13 may be formed of or integrated into the directional element 16.

The sole unit 12 provides foot support, cushioning, energy return, stability, torsion control, and optionally abrasion resistance to the user. The functional advantages of this construction of the sole unit 12 are primarily achieved through the directional element 16 and cushioning element 18, each of which handle certain distinct functions of the shoe 10, whereas with the traditional shoe, the whole shoe construction takes over every function of the shoe.

Looking now at FIGS. 2–5, details of a directional element 16 will now be described in detail. The directional element 16 has top and bottom plates 24 and 26 made of a semi-rigid but resiliently flexible material. The top plate 24 has a similar shape to the bottom plate 26. Overall, the directional element 16 generally corresponds to the length, width and peripheral contours of a user's foot. For stability and support reasons, the bottom plate 26 may be scaled to a larger size relative to the top plate, as can be seen in the FIGURES. Although the directional element 16 is shown to extend at least the length of a foot, it could be limited to certain regions, such as the forefoot or the rearfoot, and be integrated into other known footwear sole-unit systems. The directional element 16 has multiple generally parallel strut elements 22 oriented transversely to the longitudinal axis of the element 16 and connected to the top plate 24 and the bottom plate 26. Generally, the strut elements 22 have thin elongate profiles that are disposed perpendicularly or at a slight angle to top plate 24 and bottom plate 26. The strut elements 22 extend substantially from the medial edge to the lateral edge of lower plate 26 so that top plate 24 is supported a predetermined height above the lower plate 26. The number and spacing of the parallel strut elements 22 is determined with at least this objective in mind. Accordingly, the directional element 16, in combination with other sole unit 12 elements, provides the core of a platform for a user's foot.

Figure 3:
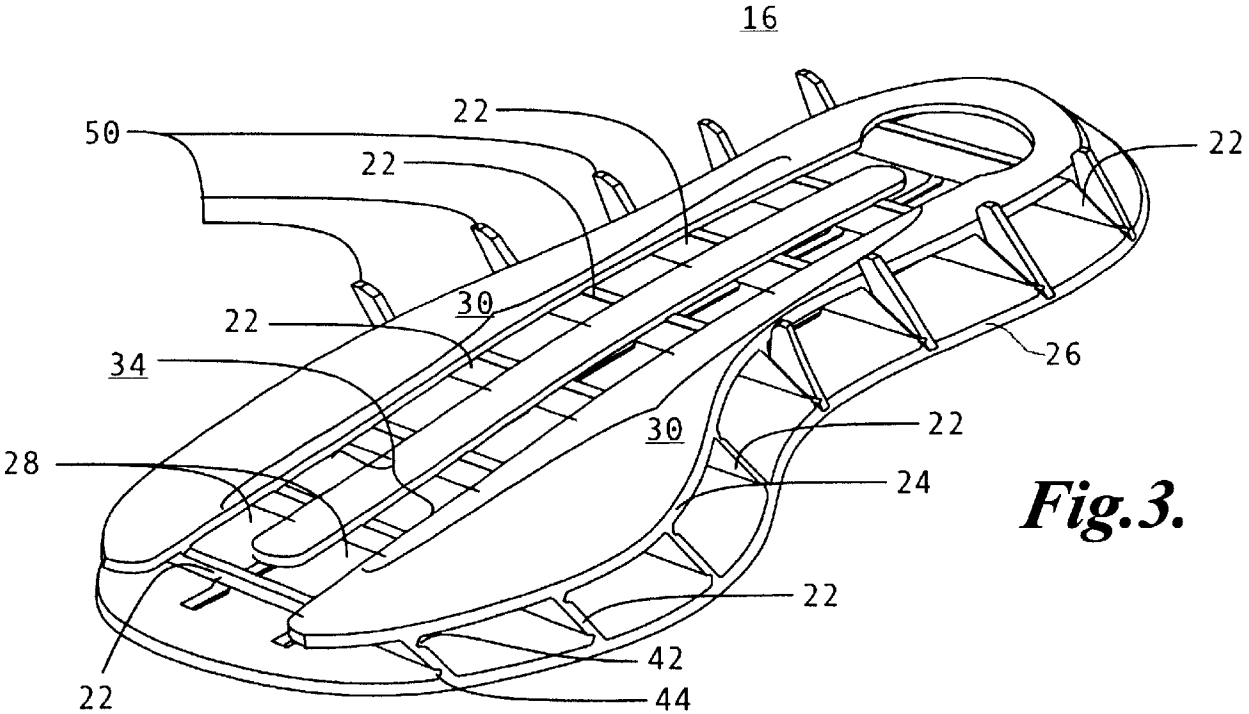
FIG. 3 is a medial side perspective view of the directional element of FIG. 2.
Figure 5:
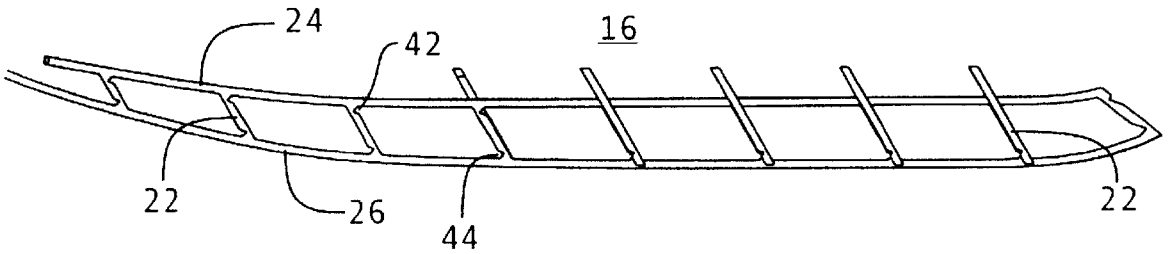
FIG. 5 is a medial side elevational view of the directional element of FIG. 2.
Figure 7:
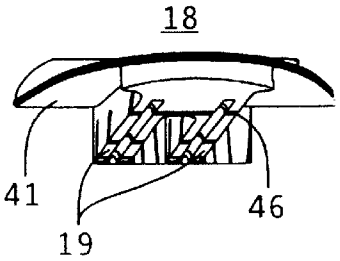
FIG. 7 is a front view of the cushioning element of FIG. 6.
Figure 6:
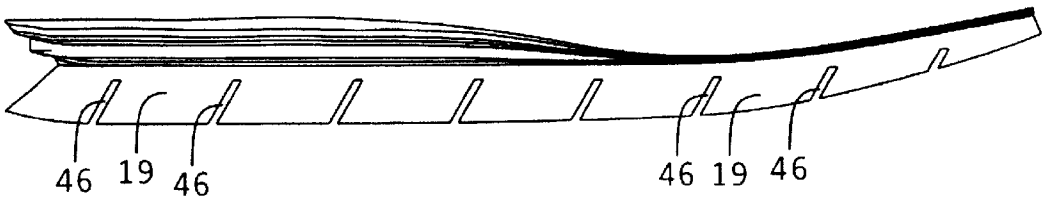
FIG. 6 is a lateral side elevational view of a cushioning element according to the present invention.

Referring now to FIGS. 1, 3 and 5, the directional element 16 includes living hinges or, flexural axes 42 and 44 at the junction where the strut elements 22 connect to the upper and lower plates 24 and 26, respectively. The axes 42 and 44 may extend the length of a strut element 22, along the junction of a strut elements 22 and the top plate 24 or the bottom plate 26. The axes 42 and 44 provide controlled deflection lines or axes that help define the directionality of how directional element 16 bends or flexes. Without flexural axes in the right places, the strut elements 22 could, for example, buckle within their lengths, or the directional element 16 could bend or flex in a manner that would be unstable to the user or reduce athletic performance. One skilled in the relevant art is capable of selecting predetermined regions for bending or flexing. Additionally, it is not necessary that all strut element-top plate junctions include flexural axes, but it is preferable to include them in at least those junctions where impact forces are greatest or where directional flexing or bending is desired.

As best shown in FIGS. 3 and 5, the hinge axes 42 and 44 may be in the form of elongate notches where the strut elements 22 intersect the top and bottom of the upper and lower plates 24 and 26, respectively. The notches shown in FIGS. 3 and 5 have opposing orientations to provide directional flexing, allowing the top plate 24 to move in predetermined directions relative to the bottom plate 26. This is discussed in more detail below.

Figure 8:
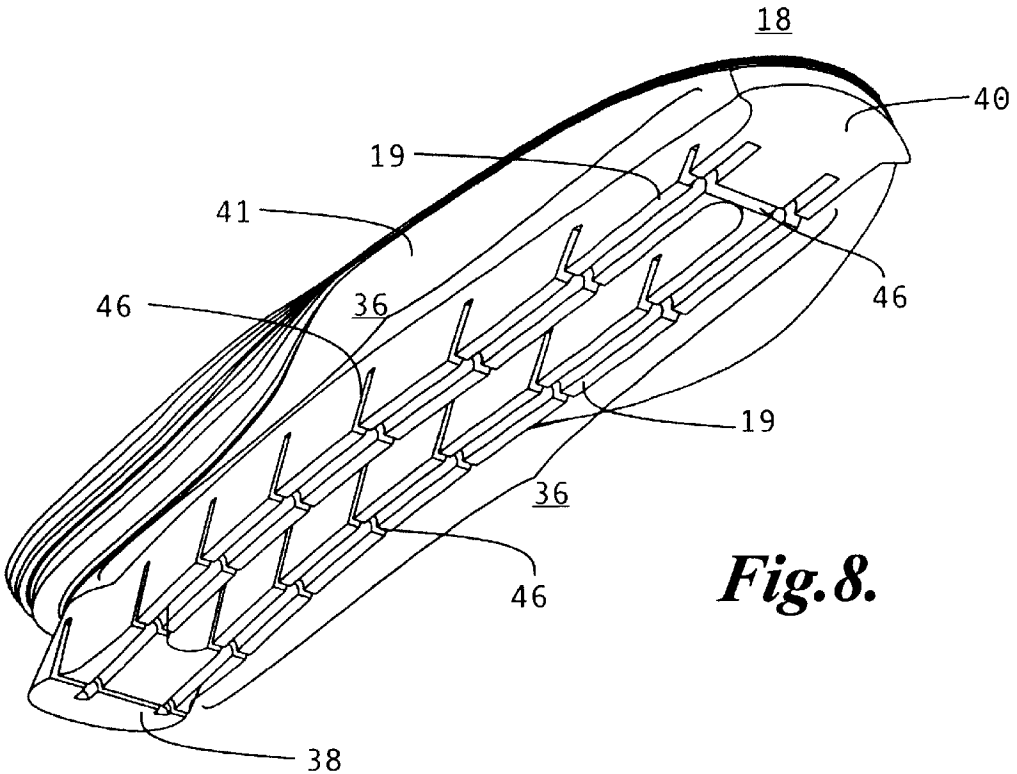
FIG. 8 is a bottom perspective view of the cushioning element FIG. 6.
Figure 9:
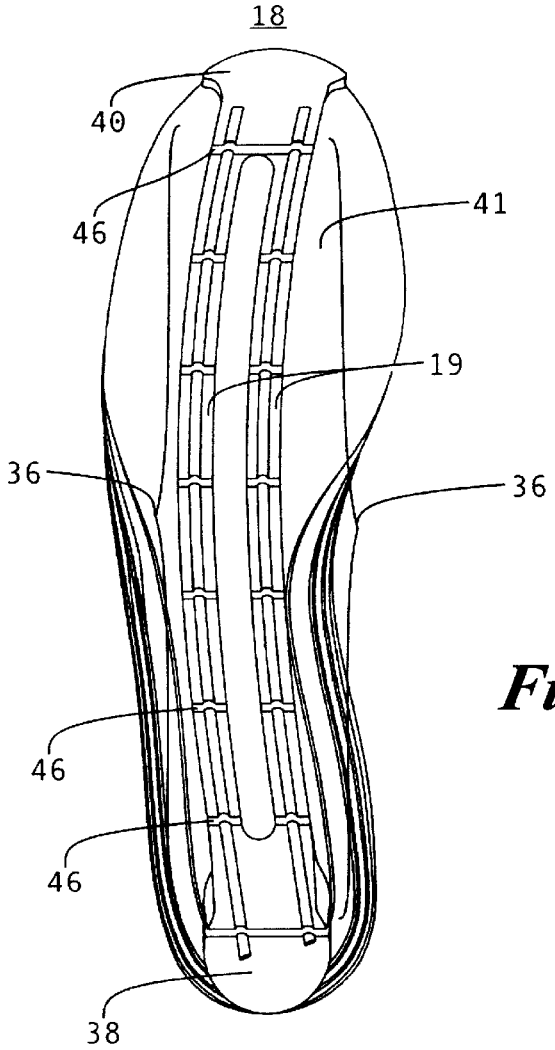
FIG. 9 is a bottom view of the cushioning element of FIG. 6.

Referring back to FIGS. 2–5, the directional element 16 further includes one or more receiving means 28, which may include openings, cutouts, gaps, etc., in predetermined locations in the top plate 24 and/or the bottom plate 26. In the embodiment shown, the receiving means 28 are arranged in two rows that run substantially along the longitudinal axis of the directional elements 16. The number, size and orientation of the receiving means 28 may vary according to how the shoe is intended to functionally perform. For example, as will be described in more detail, one function of the receiving means 28 is to allow the directional element 16 and cushioning element 18 to integrate with each other. In this regard, the receiving means 28 allows placement of cushioning means 19 (FIG. 8) under desired locations of the foot to achieve appropriate cushioning or energy return characteristics. The desirable locations and nature of such cushioning means is well known to persons skilled in the art, and may vary from shoe type to shoe type or user to user.

The receiving means 28 shown in the embodiments of the present invention comprise regions defined by an elongate opening or cutout 30, top plate 24, and side walls of adjacent strut elements 22. The top and/or bottom plates of the directional element 16 may include one or more longitudinally oriented, elongate openings along the length of a plate to create multiple receiving means 28. The top and/or bottom plates may also include one or more transverse openings to form the receiving means (not shown). The receiving means 28 may be oriented so as to provide desired flex characteristics to the shoe.

The directional element 16 shown in FIGS. 2–5 may be divided into three longitudinal zones: (1) lateral; (2) central; and (3) medial. Longitudinal, elongate openings 30 extend substantially parallel to each other along substantially the length of the directional element 16. Similar longitudinal openings 32 may be are oriented substantially along the length of the bottom of the directional element 16 to provide certain functional characteristics. One characteristic that the longitudinal openings 30 in the top and/or bottom plate may provide is decoupling of lateral forces that may occur during use of a shoe, particularly use in athletic endeavors. For example, if the top plate 24 or the bottom plate 26 were continuous and did not have the openings 30 or 32, then a load on the lateral part of the foot could translate too harshly to the medial side. The openings 30 and 32 create a central zone or buffer region that helps to decouple the lateral and medial zones from each other. Accordingly, this central zone in the top or bottom plate may be referred to as a "decoupling means" 34.

In the embodiment shown, decoupling means 34 specifically comprises a central zone defined by the pair of openings 30 that run substantially parallel along the longitudinal axis of the shoe and to an island of top plate material between the openings. This results in two steps to transfer the load from the lateral to medial side. This results in a softer, more easily controlled and comfortable shoe. In addition to an arrangement of parallel openings 30 or 32, it is contemplated that decoupling could occur by a single opening, or by use of materials in the same region as openings 30 or 32 that lessen or break forces transmitted between the lateral and medial sides of the sole unit. Such materials could include foam, fabric, elastic, and other non-rigid materials that act as a buffer to the transmission of forces.

It should be noted that the embodiment shown in FIGS. 1–12 shows decoupling substantially along the whole length of the shoe. However, the decoupling means 34 can be provided at lesser or greater lengths and in different orientations. In addition to elongate openings and other such means for decoupling, openings, gaps, etc. may also be provided to impart other functionality. For example, an appropriate elongate opening could be located to allow separation of the forefoot and rearfoot so that there is freedom of movement between those anatomical positions.

The directional element 16 is designed to mate or integrate with one or more cushioning elements 18. In the embodiment shown in FIGS. 1–12, the cushioning element 18 is designed in a generally complementary shape and size to the top plate 24 of directional element 16 and integrates therewith. Looking now at FIGS. 6–9, the cushioning element 18 includes a flexible top plate 41 which coincides substantially with the top surface of directional element 16 in the embodiment shown. The cushioning element 18 includes a plurality of cushioning means 19 that project substantially perpendicularly from top plate 41 of the cushioning element 18. In the embodiments shown, the cushioning means 19 are disposed substantially along the longitudinal length of the cushioning element 18 and correspond to the longitudinal length of a user's foot. The cushioning means 19 may be longitudinally aligned along two common paths to form two "rails" 36. A slit 46, gap, or notch may separate cushioning means 19 into discrete units in a rail 36. Toward the forefoot and rearfoot of the cushioning element 18, the rails 36 may merge together to provide a broader region of cushioning means 38 and 40. The longitudinal rails in the cushioning element are designed to fit into and extend downwardly into receiving means 28 in the directional element 16. As can be seen in FIG. 12, for example, the cushioning means 19 extend from the bottom surface of plate 41 of the cushioning element 18 down to the bottom plate 26 of the directional element 16, along the longitudinal length of cushioning element 18. Slits 46 allow the cushioning means 19 to be inserted or engage over strut elements 22. The cushioning means 19 interact directly with the strut elements 22 and the hinges 42 and 44. Preferably, the cushioning means 19 fit at least snugly between the strut elements 22 so that there is communication of forces between the cushion means 19 and strut elements 22 during use.

In an alternative embodiment, the cushioning element 18 could be designed to integrate with bottom plate 26 of the directional element 16. The receiving means 28 could be provided in the bottom plate for this purpose. The cushioning element's plate 41 in this embodiment could also serve as abrasion element 13 with cushioning means 19 projecting therefrom into the directional element 16.

In both the directional element 16 and the cushioning element 18, the thickness or height may vary depending on corresponding foot anatomy and desired shoe performance characteristics. Generally, going from the rearfoot to the forefoot, there would be decreasing height along the length of the sole unit and elements thereof. In addition, individual elements or aspects of the directional and/or cushioning element may vary in thickness.

Although cushioning element 18 is shown to provide a surface of plate 41 similar to the surface of top plate 24, plate 41 is not essential; discrete cushioning means could simply be received by one or more receiving means 28.

Figure 10:
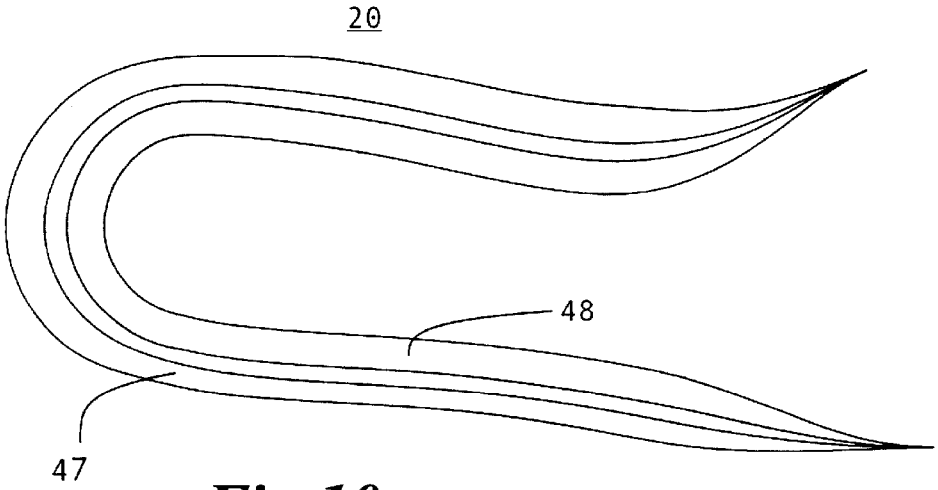
FIG. 10 is a top view of the heel cradle according to the present invention.
Figure 11:
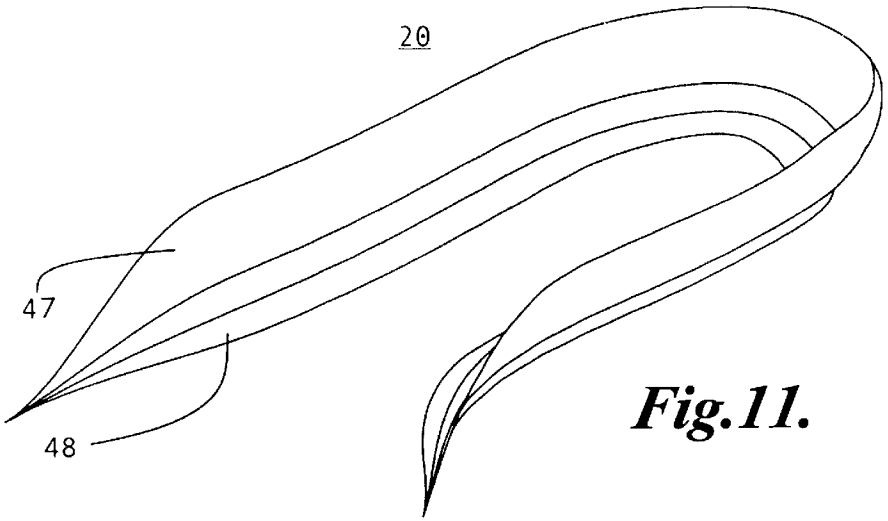
FIG. 11 is a medial perspective view of the heel cradle of FIG. 10.
Figure 12:
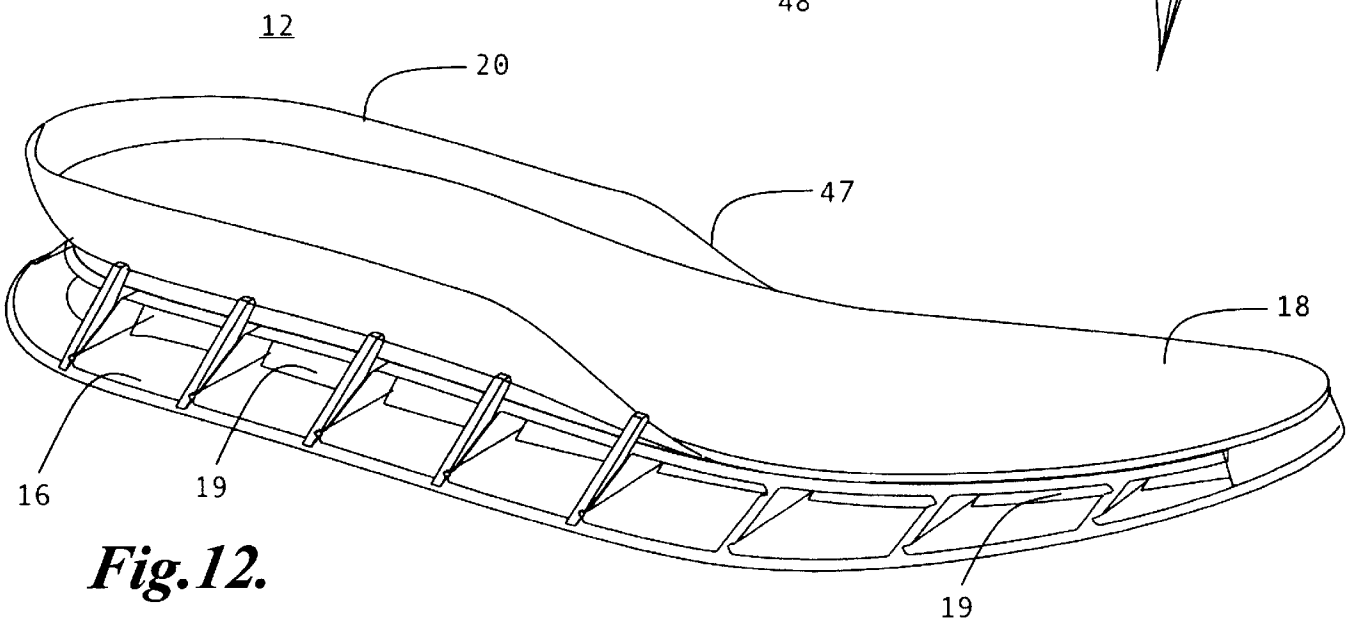
FIG. 12 is a side lateral perspective view of an assembly of a directional element, cushioning element, and heel cradle forming a sole unit according to the present invention.

Referring now to FIGS. 10 through 12, the sole unit 12 optionally includes a heel cradle 20. The heel cradle 20 provides an upwardly extending side wall 47 extending from approximately the medial mid-foot, around the heel to the lateral mid-foot. In a preferred embodiment, the heel cradle 20 has a bottom wall 48 having a lower surface that mates with the directional element 16 and an upper surface that mates with the cushioning element 18. In other words, the bottom wall 48 is sandwiched between the directional element 16 and the cushioning element 18, as best shown in FIG. 12. In the assembled sole unit 12, the side wall 47 of the heel cradle 20 extends a desired height above the cushioning element 18. The heel cradle 20 provides stability to the heel, as is known in the art. The heel cradle 20 is connected to the upper and/or directional element 16 to impart integrity to the overall sole unit 12. When connected to the directional element 16, the heel cradle increases the overall stiffness in the rearfoot region of the sole unit 12. This helps impart stability to the shoe. It is also noted that the directional element 16 includes vertically extending members 50. See FIG. 3. One function of the vertically extending members 50 is to hold together other sole unit components disposed on top plate 42 and to add stability to the shoe.

Turning now to the functionality of the sole unit 12 and elements thereof, the directional element 16 controls the direction of loading and deflection during use of the shoe 10. The present invention is particularly suited for use as an athletic shoe for this reason. The directional element 16 provides flexibility in a longitudinal direction based on the arrangement of the strut elements 22 generally running perpendicular to the general longitudinal axis of the directional element 16. However, the parallel array of strut elements 22 provides stiffness and stability in a lateral direction because they mechanically resist flexation in such direction. Accordingly, the directional element 16 provides anisotropic flexibility/stability to the sole unit 12. The anisotropic nature imparts desired stability and performance to the shoe independent of the primary cushioning function provided by cushioning means 19, unlike conventional athletic shoes. More particularly, the arrangement of top and bottom hinges 42 and 44 and strut elements 22 allow the top and bottom plates 24 and 26 to move relative to each other. Preferably, the top plate 24 moves from a static position forward, relative to the bottom plate 26 on forward foot strike. When the strike force is removed, the top plate 24 resiliently returns to the static position. As noted, one or more decoupling means 34, particularly on the bottom plate 26 of the directional element, provide for at least partial decoupling of lateral forces.

The cushioning element 18 and/or cushioning means 19 can be tuned to serve particular needs of a user or for use in particular types of shoes. The cushioning element 18, for example, may include cushioning means of different characteristics that correspond to particular anatomical regions of a foot. For example, the forefoot region may include cushioning means having elastic properties and the rearfoot region could have cushioning properties of a visco-elastic nature. In the forefoot, the elastic properties aid in energy return or performance. In the rearfoot, the visco-elastic materials provide shock-absorption or dampening. The shoe 10 can also be tuned to accommodate pronators and supinators by providing variable cushioning on the lateral versus the medial side of the shoe. For example, the rails 36, or portions thereof, formed by the cushioning means 19 may have different properties and cushion independently of one another.

One advantage of the construction of sole unit 12 is that the cushioning element 18 and the directional element 16, or any other elements disclosed above, do not have to be permanently attached to each other, or molded to form a single unit. They may be separable so that a user can interchange the cushioning element 18, or cushioning means 19 on a cushioning element 18, to provide tunability for an individual user's cushioning preferences. For example, in this region, the use of complementary arrangements of receiving means 28 and cushioning means 19 facilitates a snap-fit relationship for easy assembly or interchangeability of parts.

The various elements of the sole unit 12 may be constructed from materials and techniques known in the footwear art. The directional element 16 may be made of a relatively stiff but resiliently flexible, fatigue-resistant plastic or polymer such as PEBAX or HYTREL®. The selected materials should be capable of relatively long elongations at the hinge locations. It is also contemplated that the directional element 16 could be composed of spring metal or composite materials, including graphite-impregnated composites, nylon, thermoplastic urethane (TPU), polypropylene, and other plastics that provide good fatigue characteristics, lightness, and other properties that are characteristics of a directional element described herein. Material properties and structures may be varied to adjust the stiffness of some or all regions of the directional element 16. The strut elements 22 may be made of the same materials as the directional element 16. Using known polymer molding techniques, the directional element 16 and cushioning element 18 may be molded in one or more pieces.

The cushioning element 18 may be generally made of EVA or polyurethane foams as are well known in the art of footwear cushioning. It is also contemplated that the cushioning means could comprise bladders of gel, liquid or gases, as is known in the shoe art. As noted, the entire cushioning element 18 can be subdivided forefoot-rearfoot, medial-lateral, or upper/lower with different cushioning components to adjust the hardness or energy-absorption characteristics of the overall system. The plate 41 of the cushioning element need not be made of the same material as cushioning means 19 or even have cushioning properties. It may serve solely as a support for the cushioning means 19. Generally, the Shore A durometer for the cushioning means 19 would be in the range of 20 to 90. The cushioning element 18 and/or cushioning means 19 could be molded of a single piece of material or could be a composite of different materials. In addition, cushioning means 19 could be in the form of a spring element or other cushioning mechanism, such as is shown in U.S. Pat. Nos. 6,115,943, 5,337,492 and 5,461,800, which are hereby incorporated by reference.

The heel cradle 20 may be made of a stiff plastic polymer or a composite material as is known in the art. The heel cradle 20 may also be molded as a separate piece or integral to the directional element 16 or cushioning element 18.

In addition, an outsole material may be attached to the bottom surface of the directional element 16 to provide abrasion resistance. Alternatively, it could be provided as part of cushioning element 18, as noted above. Outsole materials are well known in the art and include polybutadiene rubber based materials.

Figure 13:
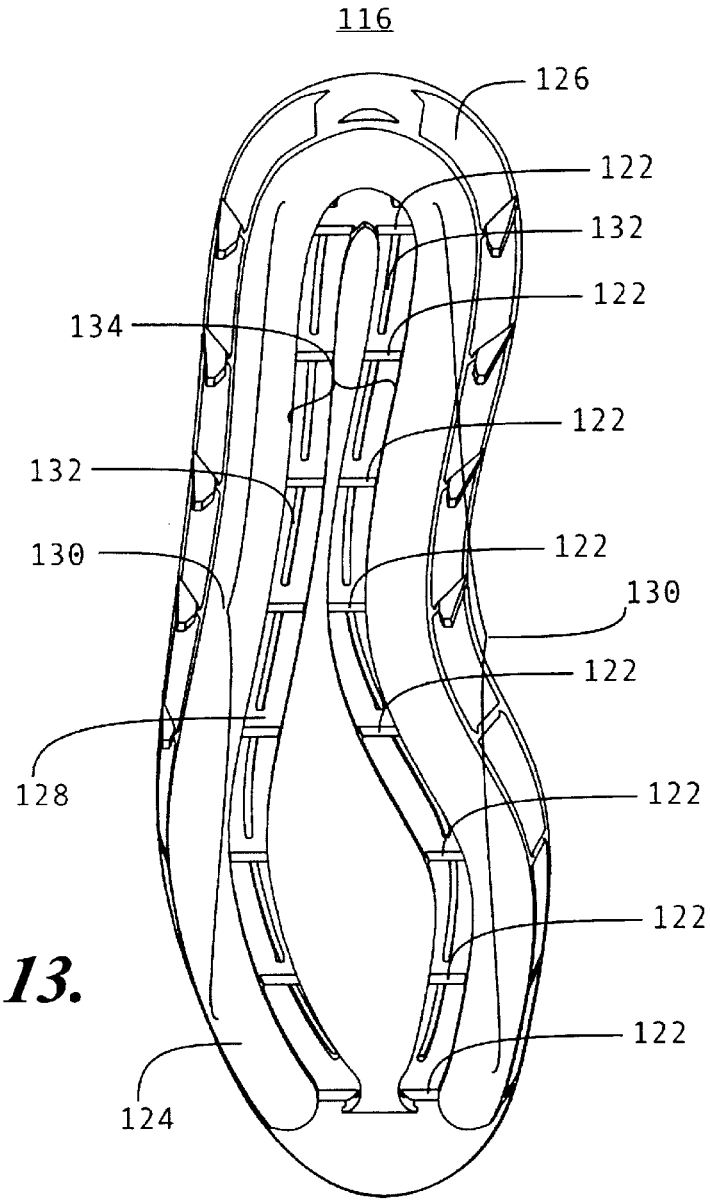
FIG. 13 is a top view of an alternative embodiment of a directional element according to the present invention.
Figure 14:
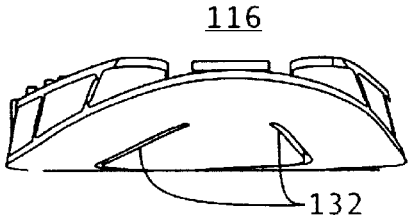
FIG. 14 is a front view of an alternative embodiment of the directional element of FIG. 13.
Figure 16:
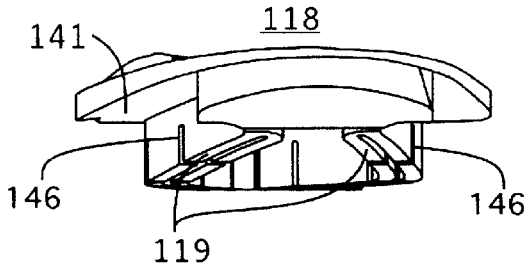
FIG. 16 is a front view of an alternative embodiment of the cushioning element of FIG. 15.
Figure 17:
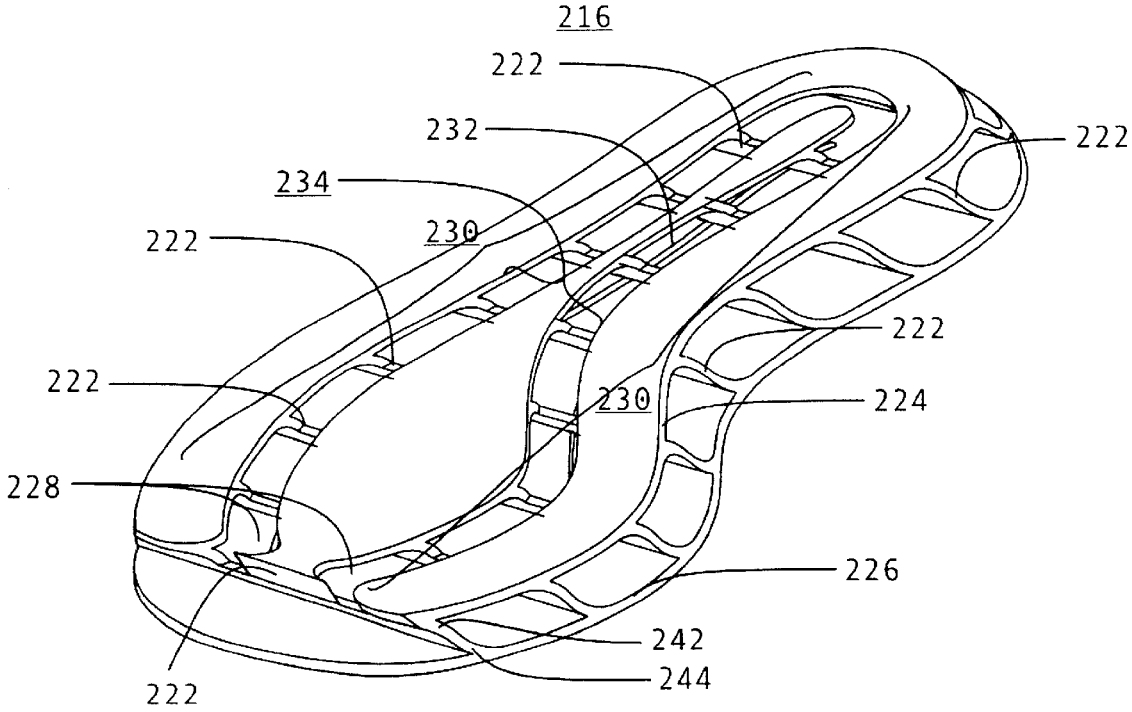
FIG. 17 is a medial side perspective view of another alternative embodiment of the directional element according to the present invention.

FIGS. 13–14 and 17 show alternative embodiments of directional elements according to the present invention. The directional elements 116 and 216 have similar or like construction, materials, and functionality as directional element 16, except for the differences that will be described below. Reference numerals in FIGS. 13–17 that are similar to reference numerals in FIGS. 1–12 relate to the same or similar element. For example, directional element 116 relates to the overall directional element 16. Directional element 116 includes strut elements 122 which correspond to strut elements 22. Similarly, directional element 216 includes receiving means 228 which correspond to receiving means 28 and 128. Directional elements 116 and 216 are similar to directional element 16. However, in both cases, the directional elements 116 and 216 have longitudinal grooves 130 and 230 that do not follow the generally parallel path as the previous version 16. The longitudinal grooves 130 and 230 start at a position near the heel, run parallel until the midfoot region, and then diverge out across the area of the directional element corresponding to the forefoot. Toward the end of the forefoot region, the grooves 130 and 230 converge toward each other.

The directional element 216 is similar to directional element 116, except directional element 216 includes strut elements 222 that do not include a notched region 42 or 44. Instead, the strut elements comprise S-shaped, thin elongate elements that provide a similar function as the combination of a strut element 22 and flexural axes 42 and 44.

Figure 15:
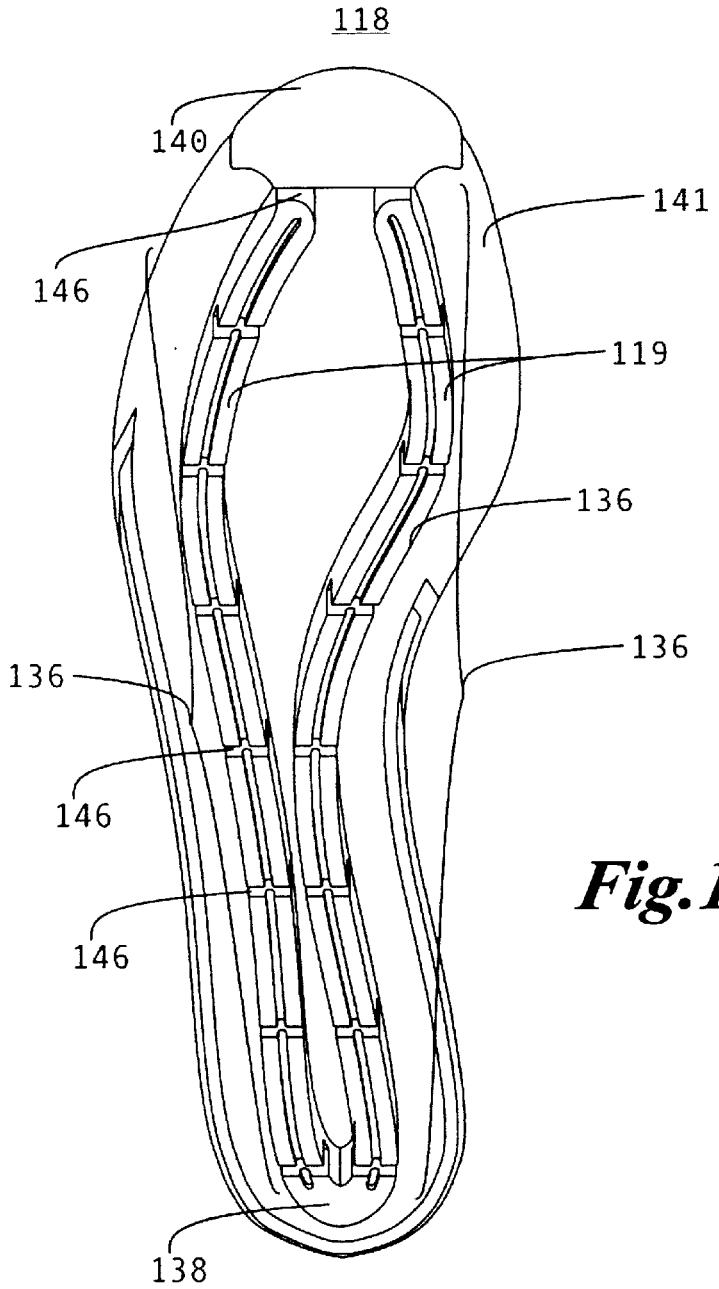
FIG. 15 is a bottom view of an alternative embodiment of a cushioning element according to the present invention.

FIGS. 15–16 show an alternative embodiment of a cushioning element 118 that include cushioning means 119, which are generally adapted to be received within the receiving means 128 or 228 of directional elements 116 or 216. In this regard, cushioning means 119 are generally complementary to receiving means 128 or 228. Since the receiving means 128 and 228 are oriented so as to converge away from each other in the forefoot area, they provide a broader spacing of cushioning means 119 for more cushioning and support across the width of the forefoot.

The S-shaped construction of the strut elements 222 allow for translation of upper plate 224 relative to bottom plate 226, and may also provide a cushioning effect based on their spring-like design. In this regard, the spring characteristics of the strut elements 222 may be sufficient to obviate the need for cushioning element 118 or cushioning means 119.

As will be appreciated to those skilled in the art, in addition to strut elements 22, 122 and 222, the strut elements could be in other forms that provide separation of top and bottom plates of the directional element, and allow a predetermined, resilient translation of the top and bottom plates, and/or a cushioning effect. For example, the strut elements could be round, oval, or square tubes, or tubes of other geometries. The strut elements of other two or three-dimensional structures are also possible and contemplated for use in this invention.

While the preferred embodiment of the invention has been illustrated and described, it will be appreciated that various changes can be made therein without departing from the spirit and scope of the invention.

What is claimed is:

1. A sole unit for a shoe having a heel end and a toe end comprising:

a directional element operable to provide flexibility in a longitudinal direction of the sole unit and to provide stiffness in a lateral direction of the sole unit, wherein the directional element includes a top member, a bottom member, and a plurality of resiliently flexible strut members connected therebetween for supporting the top member a spaced distance away from the bottom member in a static condition; and a cushioning element operably coupled to the directional element, the cushioning element operable to absorb an impact force applied to the directional element, wherein the cushioning element includes a top member corresponding to and overlying a portion of the top member of the directional element, and at least one cushioning member extending outwardly therefrom, the cushioning member adapted to be received between two strut members.

2. The sole unit of claim 1, wherein the directional element is adapted to extend from the heel end to the toe end of the shoe.

3. The sole unit of claim 1, further comprising means for decoupling the lateral forces transmitted from the lateral side to the medial side of the sole unit.

4. The sole unit of claim 1, wherein the strut members are disposed substantially transverse to the longitudinal axis of the sole unit.

5. The sole unit of claim 4, wherein the strut members extend from the medial side to the lateral side of the sole unit.

6. The sole unit of claim 1, wherein at least one of the strut members is operable to bend about a minor axis of the sole unit in a controlled manner adjacent the connection location between the bottom member and the strut member.

7. The sole unit of claim 1, wherein at least one of the plurality of strut members is operable to bend about a minor axis of the sole unit in a controlled manner at the connection interface between the top member and the strut member.

8. The sole unit of claim 1, wherein the interface between the top member and at least one of the strut members includes a notch for providing controlled deflection of the strut member.

9. The sole unit of claim 1, wherein the interface between the bottom member and at least one of the strut members includes a notch for providing controlled deflection of the strut member.

10. The sole unit of claim 1, wherein the interface between the bottom member and the strut members and the top member and the strut members each include a notch for providing controlled deflection of the strut members, wherein the notches at the interface between the bottom member and the strut members open in a direction opposite of the notches at the interface between the top member and the strut members.

11. The sole unit of claim 1, wherein the cross-section of the strut members are S shaped.

12. The sole unit of claim 1, wherein the directional element includes a receiving means for selectively receiving a portion of the cushioning element in an interchangeable manner.

13. The sole unit of claim 1, wherein the directional element further comprising an open ended cavity for selectively receiving a portion of the cushioning element in an interchangeable manner.

14. A sole unit for a shoe having a heel end and a toe end, comprising:

a directional element operable to provide flexibility in a longitudinal direction of the sole unit and to provide stiffness in a lateral direction of the sole unit, the directional element including a top member, a bottom member, and a plurality of resiliently flexible strut members connected between the top and bottom members from the medial side to the lateral side of the sole unit for supporting the top member a spaced distance away from the bottom member in a static condition; and a cushioning element operably coupled to the directional element, the cushioning element operable to absorb an impact force applied to the directional element;

wherein the directional element further comprises an open ended cavity formed between two strut members and an opening in either the top or bottom member for selectively receiving a portion of the cushioning element in an interchangeable manner.

15. The sole unit of claim 14, wherein the opening in either of the top or bottom member is operable to decouple the lateral forces transmitted from the lateral side to the medial side of the sole unit.

16. The sole unit of claim 1, wherein the cushioning element includes a plurality of cushioning members each received between strut members.

17. A sole unit for a shoe having a heel end and a toe end, comprising:

a directional element operable to provide flexibility in a longitudinal direction of the sole unit and to provide stiffness in a lateral direction of the sole unit, wherein the directional element includes a top member, a bottom member, and a plurality of resiliently flexible strut members connected therebetween for supporting the top member a spaced distance away from the bottom member in a static condition; and a cushioning element operably coupled to the directional element, the cushioning element operable to absorb an impact force applied to the directional element, wherein the cushioning element includes a top member corresponding to and overlying the top member of the directional element, and at least one cushioning member extending outwardly therefrom, the cushioning member adapted to be received between two strut members.

18. A sole unit comprising:

a directional element adapted to be connected to an upper of a shoe, the directional element including a top member, a bottom member, and a plurality of resiliently flexible strut members therebetween for supporting the top member a spaced distance away from the bottom member, the strut member having an S shaped cross-section when intersected by an imaginary plane that intersects the top and bottom plates at approximate right angles, wherein the directional element is operable to provide flexibility and stiffness anisotropically to the sole unit in the longitudinal and lateral direction of the sole unit, respectively; and a cushioning element adapted to be received by the directional element, the cushioning element operable to absorb an impact force applied to the top or bottom member.

19. A sole unit for a shoe comprising:

a directional element including a top member, a bottom member, and a plurality of spaced apart resiliently flexible strut members extending between the top and bottom members from the medial side to the lateral side of the sole unit for supporting the top member a spaced distance away from the bottom member; and a plurality of cushioning members adapted to be received by the directional element, the cushioning members operable to absorb an impact force applied to the top or bottom member;

wherein the directional element further comprises an open ended cavity formed between two strut members and an opening in either the top or bottom member for selectively receiving one of the cushioning members in an interchangeable manner.

20. A shoe having a toe end and a heel end comprising:

an upper extending between the heel end and the toe end of the shoe; and a sole unit connected to at least a portion of the upper, the sole unit comprising (a) a directional element having a top member, a bottom member, and a plurality of spaced apart resiliently flexible strut members extending between the top and bottom members from the medial side to the lateral side of the sole unit for supporting the top member a spaced distance away from the bottom member, the directional element operable to provide flexibility in a longitudinal direction of the sole unit and to provide stiffness and stability in a lateral direction of the sole unit; and (b) a cushioning element adapted to be received by the directional element between the strut members, the cushioning element operable to absorb an impact force applied to the top or bottom member;

wherein the cushioning element includes a top member corresponding to and overlying a portion of the top member of the directional element and at least one cushioning member extending outwardly therefrom, the cushioning member adapted to be received between two strut members.

21. The shoe of claim 20, wherein the sole unit extends between the heel end and the toe end of the shoe.

22. The shoe of claim 20, wherein the plurality of cushioning members have different stiffness values.

23. The shoe of claim 22, wherein the stiffness values of the cushioning members vary from the medial side to the lateral side of the sole unit.

24. The shoe of claim 22, wherein the cushioning members proximal to the toe end of the shoe provide energy return, and wherein the cushioning members proximal to the heel end of the shoe provide shock-absorption or dampening.

25. A modular sole construction comprising:

a generally elongated directional element comprised of a top member, a bottom member, and a plurality of spaced-apart resiliently flexible strut members extending between the top and bottom members thereby forming cavities therebetween, the top or bottom member including an opening extending along a portion thereof, wherein the opening is connected to at least one of the cavities formed in-between adjacent strut members; and a cushioning element including a plurality of cushioning members, the cushioning element sized and configured to be selectively coupled to the directional element in a cooperating manner such that at least one of the cushioning members extends into one of the cavities from the opening in the top or bottom member and substantially occupies said cavity.

26. The modular sole construction of claim 25, wherein a portion of the cushioning member contacts adjacent strut member when selectively coupled to the directional element.

* * * * *